US006000694A

United States Patent [19]

Krüger et al.

[11] Patent Number: 6,000,694

[45] Date of Patent: Dec. 14, 1999

[54] DRIVE SYSTEM FOR AN OSCILLATING PREGRIPPER OF A SHEET-FED PRINTING MACHINE

[75] Inventors: Michael Krüger, Edingen-Neckarhausen; Bernhard Wagensommer, Gaiberg, both of Germany

[73] Assignee: Heidelberger Druckmaschinen AG, Heidelberg, Germany

[21] Appl. No.: 08/847,892

[22] Filed: Apr. 28, 1997

[30] Foreign Application Priority Data

Apr. 26, 1996 [DE] Germany ..... 196 16 755

[51] Int. Cl.[6] ..... B65H 5/12; B65H 5/34; B65H 5/02; B41F 1/30

[52] U.S. Cl. ..... 271/268; 271/270; 271/277; 101/410; 101/409

[58] Field of Search ..... 271/267, 268, 271/270, 85, 277; 101/410, 409

[56] References Cited

U.S. PATENT DOCUMENTS

| | | | |
|---|---|---|---|
| 4,458,893 | 7/1984 | Ruh | 271/277 |
| 5,024,432 | 6/1991 | Thunker et al. | 271/268 |
| 5,176,079 | 1/1993 | Pollich | 101/410 |
| 5,343,806 | 9/1994 | Fricke et al. | 101/410 |
| 5,390,601 | 2/1995 | Fricke et al. | 101/410 |
| 5,456,128 | 10/1995 | Thunker | 101/409 |
| 5,596,929 | 1/1997 | Fricke et al. | 101/410 |
| 5,651,544 | 7/1997 | Stadler | 271/268 |

FOREIGN PATENT DOCUMENTS

| | | | |
|---|---|---|---|
| 0287143 | 10/1988 | European Pat. Off. | 271/85 |
| 23 47 568 | 4/1975 | Germany . | |
| 31 38 540 A1 | 4/1983 | Germany . | |
| 291 729 A5 | 1/1990 | Germany . | |
| 39 22 186 C2 | 1/1991 | Germany . | |

*Primary Examiner*—William E. Terrell
*Assistant Examiner*—Wonki K. Park
*Attorney, Agent, or Firm*—Herbert L. Lerner; Laurence A. Greenberg

[57] ABSTRACT

A drive system for an oscillating gripper of a sheet-fed printing machine has a main drive train and a controlled drive. The pregripper is mechanically coupled to the main drive train. The controlled drive supplies energy required to drive the pregripper in accordance with a position of the pregripper. The controlled drive at least approximately meets the discontinuous energy requirement of the pregripper.

14 Claims, 5 Drawing Sheets

DRIVE SYSTEM FOR AN OSCILLATING PREGRIPPER OF A SHEET-FED PRINTING MACHINE

BACKGROUND OF THE INVENTION

Field of the Invention

The invention relates to a drive system for an oscillating pregripper of a sheet-fed printing machine, the pregripper having energy supplied thereto by a controlled drive and in accordance with the position of the pregripper.

Heretofore known drives for pregrippers of sheet-fed printing machines were conventionally formed of a cam gear which was connected to a main drive train of a respective printing machine and drove the pregripper from the drive side of the machine. Because the pregripper is a machine part which has to be accelerated and braked continuously, severe reactions occur on the drive train of the machine. This leads to flank or side changes in the drive and to an excitation of oscillations of the machine and, consequently, to ghosting or slurring, i.e., a degradation of the printing quality. Because of the great forces which occur, a considerable outlay or expense was necessary for the pregripper gearing. The cam gears, in particular, the cam rollers, were subject to great wear. Because this outlay and wear become greater with increasing machine speeds, those concerned with development were forced to seek a solution, in light of the ever faster running machines.

Thus, the published German Patent Document DE 39 22 186 C2 proposed compensating gearing having springs, wherein energy is stored when the pregripper is braked, the energy being removed again for accelerating the pregripper. Because different accelerations of the pregripper are also required, however, at different speeds, various forces occur, depending upon the production speed. In contrast, the proposed attempt at a solution in this German patent document is capable of achieving compensation for only one production speed.

A further proposal was made in the published German Patent Document DE 31 38 540 A1 wherein a pregripper drive is completely separated from the main drive train of the machine and is provided with a dedicated drive, which is controlled by a computer in accordance with the machine position or setting and the machine speed. In this regard, however, the problem arises that, upon the occurrence of any faults in or a failure of the drive electronics, for example as a result of a power failure, a collision of the mechanical systems occurs, which leads to the destruction of the machine.

It is accordingly an object of the invention to provide a drive for an oscillating pregripper of a sheet-fed printing machine, the operational reliability of which is guaranteed.

SUMMARY OF THE INVENTION

With the foregoing and other objects in view, there is provided, in accordance with the invention, a drive system for an oscillating pregripper of a sheet-fed printing machine having a main drive train, comprising a controlled drive for supplying required energy discontinually to the pregripper in accordance with the position of the pregripper, the pregripper being mechanically coupled to the main drive train of the printing machine, and the controlled drive being capable of at least approximately meeting the discontinuous energy requirement of the pregripper.

In accordance with another feature of the invention, the controlled drive is capable of withdrawing movement energy from the pregripper in accordance with the position of the pregripper.

In accordance with a further feature of the invention, the drive system includes a cam control for the pregripper having a control shaft, the controlled drive being capable of acting upon the control shaft.

In accordance with an added feature of the invention, the pregripper has a gripper-bar shaft, and the controlled drive is assigned to the gripper-bar shaft.

In accordance with an additional feature of the invention, the pregripper has at least two oscillating levers, the controlled drive being assigned to at least one of the oscillating levers.

In accordance with yet another feature of the invention, the printing machine has a drive side as well as an operating side, the controlled drive being capable of acting upon the pregripper both on the drive side and on the operating side of the printing machine.

In accordance with yet a further feature of the invention, the controlled drive is a rotary angle drive or a rotary magnet.

In accordance with yet an added feature of the invention, at least one linear drive is assigned to at least one of the oscillating levers.

In accordance with yet an additional feature of the invention, the linear drive has a segment-shaped construction.

In accordance with still another feature of the invention, coils are assigned to the at least one oscillating lever, and magnets are assigned to a stator of the at least one linear drive.

In accordance with an alternative feature of the invention, magnets are assigned to the at least one oscillating lever, and coils are assigned to a stator of the at least one linear drive.

In accordance with still a further feature of the invention, the drive system is pneumatically operative.

In accordance with still an added feature of the invention, the drive system includes a control system for controlling the controlled drive based upon defined angular position-dependent and rotational speed-dependent data, and an incremental encoder for detecting data regarding the angular position and rotational speed of the main drive train and for feeding the data to the control system.

In accordance with a concomitant and alternative feature of the invention, the drive system includes a control system for controlling the controlled drive in accordance with torsion of a gripper-bar shaft mounted in the printing machine and pivotally supporting the pregripper, and a sensor for detecting the torsion of the gripper-bar shaft and for feeding data regarding the torsion to the control system.

By providing, in accordance with the invention, that the pregripper be mechanically coupled to the main drive train of the machine and that the controlled drive approximately meet the discontinuous energy requirement of the pregripper, possible destruction of the machine due to failure of the electronics, as a result of a malfunction or of a power failure is prevented. The mechanical coupling to the main drive train is relieved of continuously acting high forces due to acceleration and braking of the pregripper, but is capable of absorbing the forces for a short time in order to prevent a collision in the event of a failure of the controlled drive. It is no longer necessary to expend great mechanical efforts on the pregripper gearing, and wear is reduced to a minimum. Without risk of collision, the feeding of energy to the drive system of the pregripper can be set to the various machine speeds. A setting in accordance with the condition of the material to be printed, for example, the paper weight, is also possible. Flank or side change and oscillations are avoided to the greatest possible extent, as a result of which ghosting or slurring is prevented and the printing quality is improved. Feeding energy by the controlled drive can meet or cover both the acceleration of the pregripper, as well as the braking thereof by energy extraction or removal.

The controlled drive can be connected to the pregripper in various ways. For example, it may act upon the control shaft for the cam control of the pregripper.

An expedient development provides for the controlled drive to be assigned to the gripper-bar shaft of the pregripper. The advantage of this construction is that the cam drive, i.e., the cam, the roller and the roller lever, are no longer loaded by high forces. This reduces the required mechanical effort or expense.

The controlled drive can, however, also be assigned to at least one of the oscillating levers of the pregripper. Consequently, the gripper-bar shaft and the bearing thereof can also be provided with smaller dimensions.

The drive is expediently configured in such a manner that it acts upon the pregripper both on the drive side and also on the operating or front side of the machine. In this manner, the acceleration and the braking of the pregripper acts symmetrically, and torsion of the pregripper shaft no longer occurs. This offers the advantage that the angular errors which would consequently occur in the gripper bar are avoided and higher register accuracy over the width of the sheet and, hence, better printing quality are achieved. A further advantage is that the drive on both sides leads to a reduction in the overall loading of the pregripper, which reduces bending and bearing forces. This measure also results in considerably quieter running of the machine.

The drive may again be configured in diverse ways. For example, if the drive is assigned to the gripper-bar shaft, it can then be a rotary angle drive or a rotary magnet.

It is particularly expedient if at least one linear drive is assigned to at least one of the oscillating levers. If levers are arranged on both sides, one or more drives can be provided on both sides. In the case of more than two levers, for example, if a lever is assigned to each of the grippers, then each of these levers can have a drive assigned thereto. The controlled drive is then a multiple drive. In this regard, the linear drives can be assigned to the levers in any desired number at any desired location, in order to support the movement thereof. Expediently, one drive is assigned per lever.

Due to such linear drives, the loading on the lever arms is reduced, and the lever arms can be configured in a less complicated manner and therefore with lower mass. This in turn leads to the result that the drive of the pregripper is able to be of smaller dimensions and, consequently, less oscillations are produced. Expediently, the linear drive is arranged at a distance relatively far from the point of rotation of the lever, in order to achieve good force transmission and to reduce the loading on the levers.

A particularly expedient development provides for the linear drive to be of segment-shaped construction. This configuration offers the advantage that no guide rail running along the lever is necessary for the linear drive.

It is further proposed herein that, in the case of an electrical linear drive, the coils be assigned to the lever and the magnets be assigned to the stator of the linear drive or drives. This offers the advantage that the coil, which has a significantly lower mass than the magnets, is assigned to the moving part and, consequently, the pregripper experiences only a small growth in mass. In the event that it is more beneficial in terms of construction, for example, because of the power supply, to assign the coil to the stator, the converse variation in construction is of course also possible.

The drive may of course be configured in the most diverse manner. Continuously running drives are also conceivable, or it is even possible to provide a pneumatic rotary-angle drive or linear drive.

With respect to the control of the drive, a proposal made herein provides that, by the use of an incremental encoder, the angular position and rotational speed of the main drive train are registered or detected and are fed to a controller or control system which controls the drive based upon defined position-dependent and speed-dependent data. In this regard, it is necessary for the incremental encoder to have a fixed zero position, in order that the angular position can always be registered starting from this zero position. The definition of the data is performed in accordance with or as a function of the design of the machine. This may be determined by computer or by tests or trials. It is possible, however, also to take into account as well, in such a control system, the condition of the printed material, in particular the weight of the material to be printed, at the same time. The main machine rotary-angle transmitter or encoder may also serve as the incremental encoder. This makes the drive more cost-effective.

Another possibility for the control system provides that a sensor register or detect the torsion of the gripper-bar shaft and feed the data relative thereto to a controller, which controls the drive in accordance with or as a function of the torsion of the gripper-bar shaft. The advantage of this embodiment is that the discontinuous energy requirement of the pregripper behaves in a manner directly proportional to the torsion of the gripper-bar shaft and, as a result, a definition of data is unnecessary. It is sufficient merely to enter a proportionality factor.

The invention thus relates to a drive for an oscillating pregripper of a sheet-fed printing machine, energy being supplied to the pregripper by a controlled drive and as a function of position. In the prior state of the art, such a drive was implemented by decoupling the pregripper drive completely from the main drive train of the machine. However, this involves the risk that, in the event of any faults in the drive electronics or in the event of a power failure, a collision of the mechanical systems occurs. The intention of the invention is to avoid this and to ensure operational reliability, it being the intention, however, to maintain a position-dependent supply of energy in order to avoid the production of oscillations. The object of the invention is achieved by providing that the pregripper be mechanically coupled to the main drive train of the machine, and the controlled drive approximately meet or cover the discontinuous energy requirement of the pregripper.

Other features which are considered as characteristic for the invention are set forth in the appended claims.

Although the invention is illustrated and described herein as embodied in a drive for an oscillating pregripper of a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
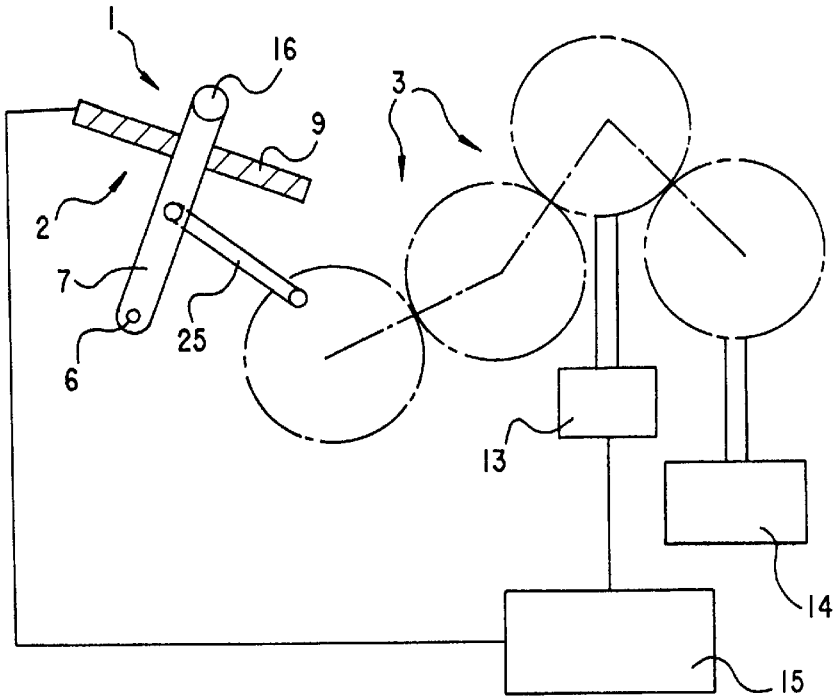
FIG. 1 is a diagrammatic and schematic view of an exemplary embodiment of the drive for an oscillating pregripper of a sheet-fed printing machine according to the invention.

Referring now to the drawings and, first, particularly to FIG. 1 thereof, there is shown therein a diagrammatic and schematic illustration of a first exemplary embodiment of the drive of a pregripper 1 in accordance with the invention. The pregripper 1 has two oscillating levers 7, which are pivotally mounted at one end thereof in the machine housing by a gripper-bar shaft 6, and carry at the other end thereof a gripper bar 16 of the pregripper 1. A mechanical coupling of the pregripper 1 to the main drive train 3 of the printing machine is illustrated symbolically by a transfer lever 25, due to which the oscillating movement of the levers 7 is also readily apparent. The discontinuous energy requirement of the pregripper 1, caused by the oscillating movement thereof, is fulfilled by a linear drive 9 which accelerates or brakes the oscillating levers 7 with the aid of a control system 15. The position-dependent supplying or removal of movement energy is performed by an incremental encoder 13 which is arranged on the main drive train 3 and transmits data about the machine position and the rotational speed to the control system 15. For determining the angular position, it is necessary to start from a defined zero position in order to attain a clear assignment of the angular position of the main drive train 3 to the position of the pregripper 1 and, thereby, determine the required energy supply. For this purpose, an allocation of the energy supply and discharge in accordance with the angular position and the rotational speed must be entered into the control system 15.

The main drive train 3 of the machine is driven by a main drive 14. As mentioned hereinbefore, the control system 15 can also be connected to a sensor which determines or registers the torsion of the gripper-bar shaft 6. The drive 2 can then have accelerative or braking energy applied directly thereto as a function of the torsion of the gripper-bar shaft 6.

Figure 2:
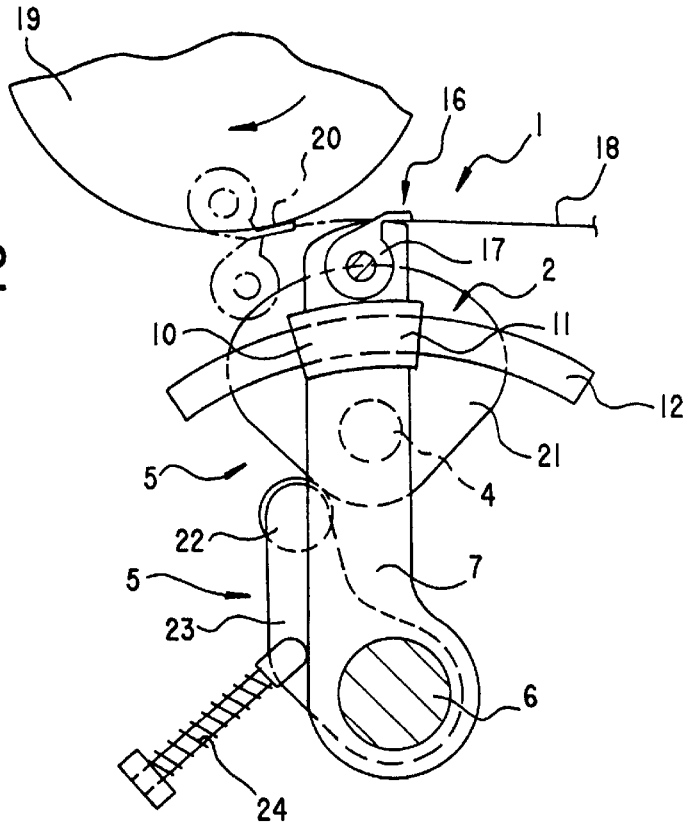
FIG. 2 is a side elevational view of a pregripper with a drive according to the invention.

FIG. 2 illustrates an embodiment of a pregripper 1 with a drive according to the invention. As shown therein, a pregripper 1 is connected via a cam control 5 to the main drive train 3 of the printing machine. The main drive train 3 drives a control shaft 4 carrying a cam 21 which, via a roller 22 which is pressed against it by a spring 24 and a roller lever 23, pivots the gripper-bar shaft 6. The two oscillating levers 7, which carry the gripper bar 16 of the pregripper 1, sit on the gripper-bar shaft 6.

The oscillating movement of the pregripper 1 serves for gripping a sheet 18 from the feeder by the grippers 17 and transporting the sheet 18 to the first sheet-conveying cylinder 19 of the printing machine, in order to transfer thereat the sheet 18 to the grippers 20 of the cylinder 19. The pregripper 1 then moves back in order to bring up the next sheet 18 from the feeder. In this regard, the pregripper 1 is of conventional construction and may, of course, be configured in any other suitable manner.

In order to avoid performing the acceleration and braking of the pregripper 1 via the cam control 5, it is proposed, in accordance with the invention, that a controlled drive 2 meet the discontinuous energy requirement of the pregripper. The controlled drive 2 is shown configured as a linear drive 10, which has a segment-shaped form and coils 11 arranged on the two oscillating levers 7 which carry the gripper-bar shaft 16 of the pregripper 1. In this manner, on each side of the machine, the acceleration energy is supplied to the oscillating levers 7, or energy is extracted or withdrawn therefrom for the purpose of braking. Consequently, the cam control 5 is subjected to only a low loading, which occurs continuously and does not cause any oscillations. The cam control 5 can therefore be configured in a considerably less costly manner, just like the oscillating levers 7, because it has to absorb the acceleration and braking forces only in the event of failure of the linear drive 10. The coils 11, which are arranged on the oscillating levers 7, respectively cooperate with a stator 12 whereon the magnets are arranged. The control is performed as already described hereinbefore with respect to FIG. 1. The power supply to the coils 11 is expediently effected via the oscillating levers 7, for example via the pivot thereof.

Figure 3:
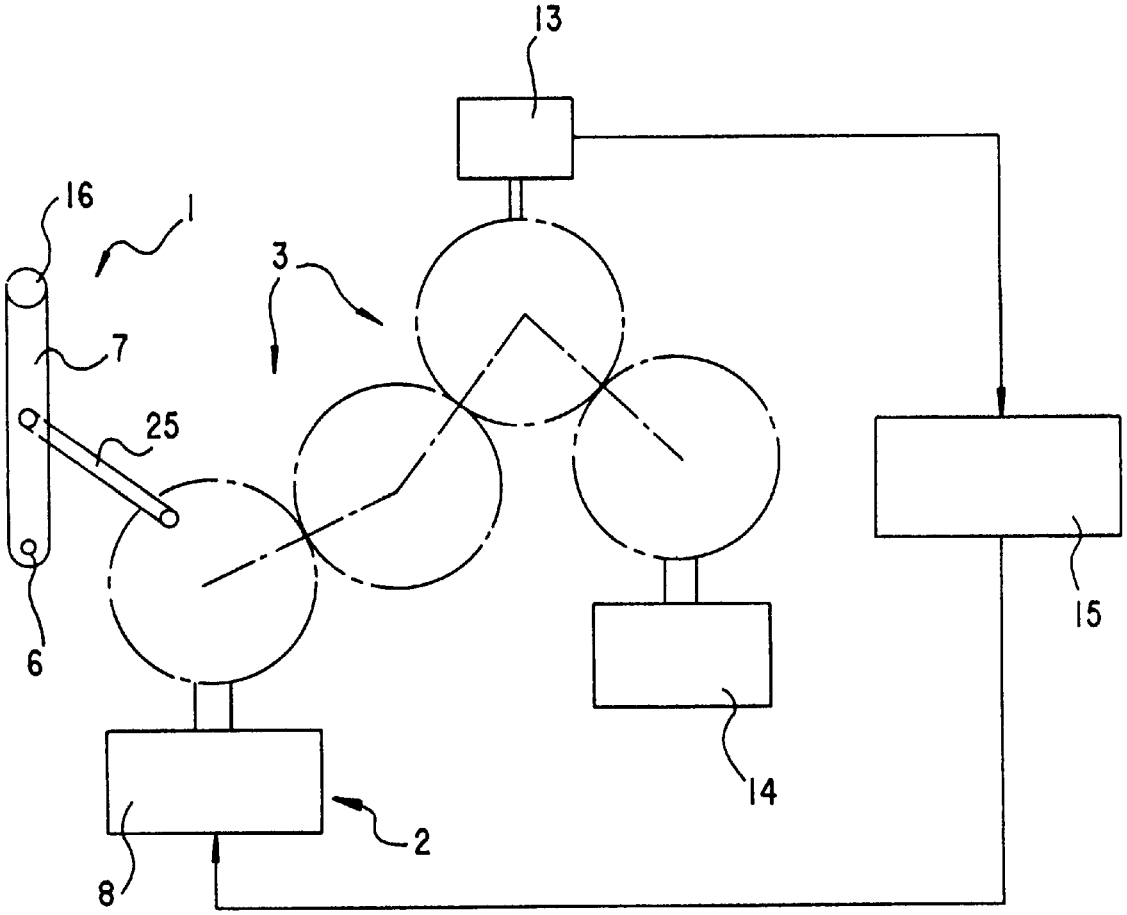
FIG. 3 is a diagrammatic and schematic view of another exemplary embodiment of the drive according to the invention.

FIG. 3 is a diagrammatic and schematic illustration of a further exemplary embodiment of the drive according to the invention. The difference therein from the exemplary embodiment of FIG. 1 is that the controlled drive 2 acts upon the last gear wheel of the main drive train 3 and, at that location, feeds in the discontinuous energy requirement of the pregripper 1. The controlled drive 2 can be configured as a rotary angle drive or rotary magnet 8. In the embodiment of FIG. 3, however, only the reaction of the forces on the machine is avoided as a result of the discontinuous movement of the pregripper 1. The advantages with respect to the configuration of the pregripper 1 itself cannot be achieved with this embodiment of FIG. 3, but it constitutes a solution for many machines in which the necessary installation space on the pregripper 1 is missing.

Figure 4:
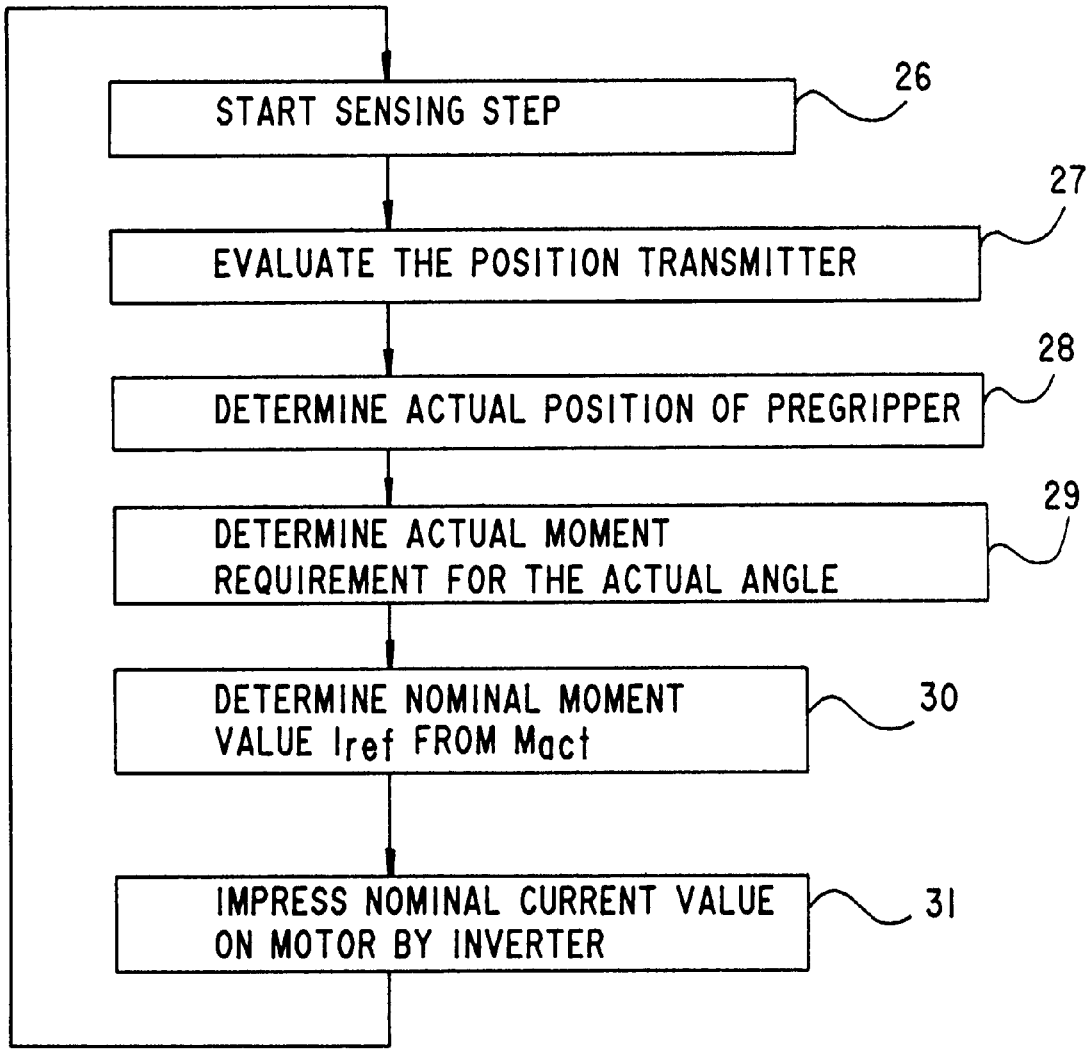
FIG. 4 is a flow diagram depicting the operation of the controlled drive according to the invention, both for linear and rotary motors.

FIG. 4 is a flow chart of the performance of the control drive which is applicable equally or equivalently for a linear and a rotary motor. The sensing step starts at 26. The position transmitter 13 is evaluated at 27, which means that the determination of the machine angle is effected by the incremental transmitter 13 in the gear train 3 of the machine. The actual position of the pregripper 1 is determined at 28. It is derived by the mechanical coupling from the actual position of the machine angle. Derived therefrom, the immediate nominal value of the torque or angular moment of the respective drive 8, 9 or 10 is determined. Thus, the actual moment requirement $M_{act}$ for the actual angle is determined at 29. The calculation of the nominal current value $I_{ref}$ is made therefrom at 30. The nominal current value $I_{ref}$ is impressed via an inverter forming part of the control system 15 into the respective drive 8, 9 or 10.

Figure 5:
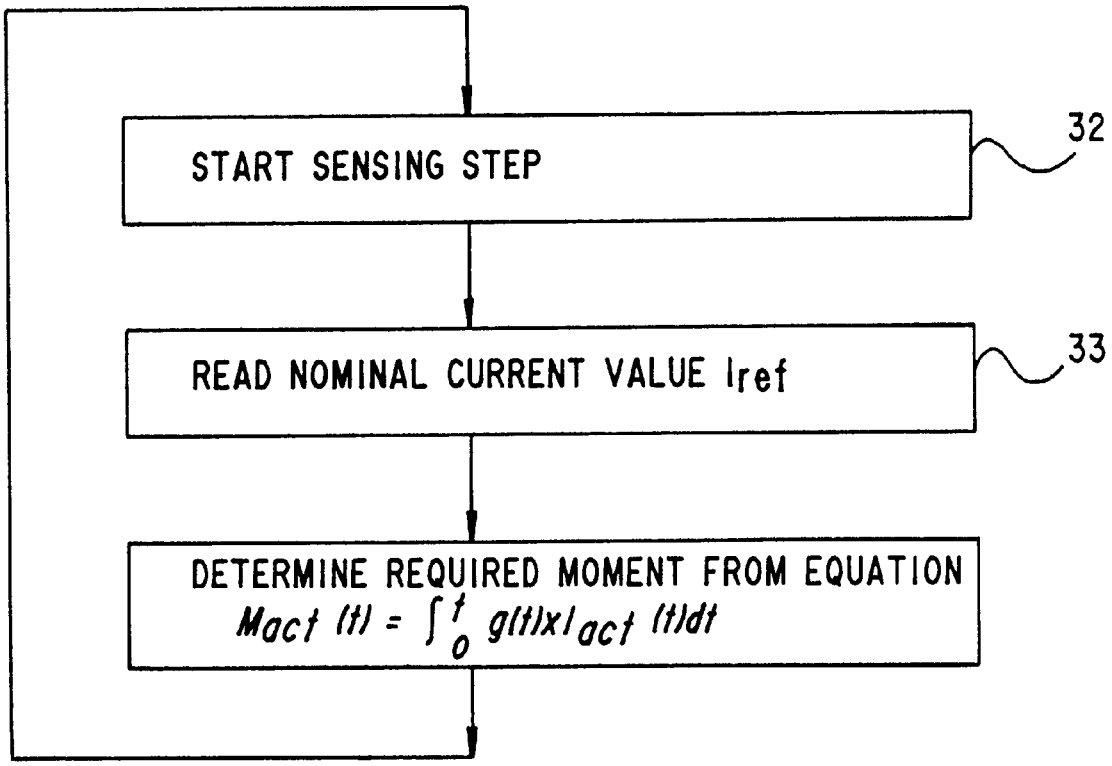
FIG. 5 is a flow diagram showing how a required moment of the controlled drive is calculated.

In FIG. 5 the transfer function g(t) of the nominal current value to the rotary moment of the motor is determined in either a laboratory or computed on-line.

Iact is equal to the actual current value and Mact is equal to the actual value of the rotary moment.

In the flow chart of FIG. 5 which could be integrated into FIG. 4, the sensing step is started at 32, the nominal value of the current $I_{ref}$ is read in at 33, and the moment requirement is determined at 34 by the equation:

$$M_{act}(t)=\int_0^t g(t)*I_{act}(t)dt$$

wherein g(t) is the transfer function from the nominal current value to the angular moment of the motor in the application, g(t) being either determined beforehand in the lab or on the job or may be calculated on-line; $I_{act}$ is the immediate current value; and $M_{act}$ is the immediate nominal value of the angular moment.

Figure 6:
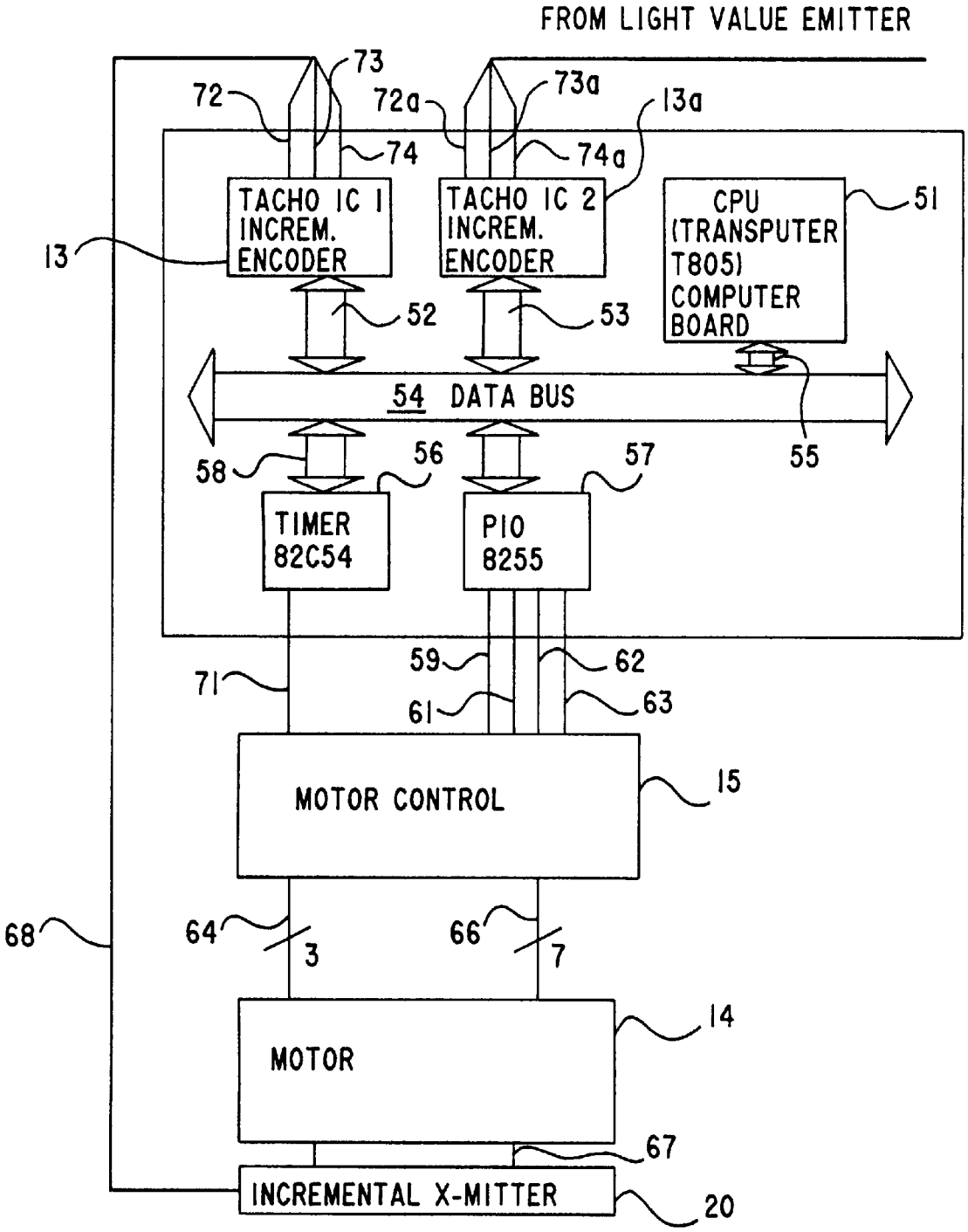
FIG. 6 is a block diagram of the drive according to the invention, including an additional incremental transmitter provided for the motor for driving the pregripper.

FIG. 6 is a block diagram of the drive according to the invention wherein, in contrast with the embodiments of the preceding figures, an additional incremental encoder 13a is applied to the motor for driving the pregripper. The information of this additional incremental encoder is compared with the information of the incremental transmitter 13 of the main drive chain (conductance transmitter) and the torsion of the gripper-bar shaft 6 is determined, as noted hereinbefore with regard to FIG. 1, as the difference between the respective angular shaft position obtained from incremental encoders 13 and 13*a*. The computation is performed by a computer CPU 51 connected by computer bus 55 to a common data bus 54 which transmits data from incremental encoders 13, 13*a* to the computer 51. A timer 56 provides the necessary timing signals for the entire system via timer 58. A programmable input-output circuit 57 provides interface information between motor control 15 and CPU 51 via data bus 54. The input/output information includes an "activate drive" signal on data line 59, a "drive on" signal on data line 61, a "compressed air on/off" on data line 62, and a "suction on/off" on data line 63. The motor control 15 provides power on line 64, and motor control signals for motor commutation on control cable 66. The motor 14 is connected via a mechanical coupling 67 to the incremental transmitter 13, which is in turn connected to the incremental encoder 13. The motor control 15 receives timing signals from timer 56 via signal line 71. The incremental transmitter 13 has a number (N) signal tracks 67, which generate angular position signals transmitted via signal line 68, transmitting data signals 72, 73, 74, to the incremental encoder 13, which transmits in conventional manner the angular position signals into angular shaft position data, that are transmitted via data bus 54 to the computer 51.

The incremental transmitter 20 is conventional, known e.g. as part BDH 05.05A1024/K14J from firm Baumer. The incremental encoders 13, 13*a* are application-specific integrated circuits (ASICS) from Siemens known as part 00781.2692. The computer CPU 51 is e.g. an INMOS Type T805-G255. The timer 56 is e.g. a programmable timer 8254. The input/output circuit 57 is e.g. an integrated programmable circuit type 8255.

We claim:

1. In a sheet-fed printing machine, a drive system, comprising:

an oscillating pregripper;

a main drive train mechanically coupled to said pregripper for driving said pregripper;

a controlled drive coupled to said pregripper for supplying a required drive energy to said pregripper in accordance with a position of said pregripper, said controlled drive being capable of at least approximately supplying the required drive energy to the pregripper, and said main drive train being configured to supply a balance of the required drive energy and configured to drive said pregripper upon failure of said controlled drive; and a control system connected to said controlled drive for controlling said controlled drive.

2. The drive system according to claim 1, wherein said controlled drive is capable of withdrawing kinetic energy from the pregripper in accordance with the position of the pregripper.

3. The drive system according to claim 1, including a cam control for the pregripper having a control shaft, said controlled drive being capable of drives the control shaft.

4. The drive system according to claim 1, wherein the pregripper has a gripper-bar shaft, and said controlled drive drives the gripper-bar shaft.

5. The drive system according to claim 1, wherein the pregripper has at least two oscillating levers, said controlled drive driving at least one of said oscillating levers.

6. The drive system according to claim 4, wherein said pregripper has a drive side as well as an operator's side, said controlled drive driving the pregripper both on the drive side and on the operator's side of said pregripper.

7. The drive system according to claim 4, wherein said controlled drive is one of a rotary drive or and a rotary magnet.

8. The drive system according to claim 5, wherein said controlled drive includes at least one linear drive for driving at least one of the oscillating levers.

9. The drive system according to claim 8, wherein said linear drive has a segment-shaped construction.

10. The drive system according to claim 8, wherein said at least one linear drive includes coils disposed on at least one of the oscillating levers, and a stator having magnets disposed thereon.

11. The drive system according to claim 8, wherein said at least one linear drive includes magnets disposed on at least one of the oscillating levers, and a stator having coils disposed thereon.

12. The drive system according to claim 1, which is pneumatically operative.

13. The drive system according to claim 1, wherein said control system controls said controlled drive based upon defined angular position-dependent and rotational speed-dependent data, and including an incremental encoder for detecting data regarding the angular position and rotational speed of said main drive train and for feeding the data to said control system.

14. The drive system according to claim 1, wherein said control system controls said controlled drive in accordance with a torsion of a gripper-bar shaft mounted in the printing machine and including pivotally supporting the pregripper, and a sensor for detecting the torsion of the gripper-bar shaft and for feeding data regarding the torsion to said control system.

* * * * *